US005277602A

United States Patent [19]

Yi

[11] Patent Number: 5,277,602

[45] Date of Patent: Jan. 11, 1994

[54] ELECTRICAL PLUG AND RECEPTACLE ASSEMBLY

[76] Inventor: Lee M. Yi, P.O. Box 82-144, Taipei, Taiwan

[21] Appl. No.: 981,416

[22] Filed: Nov. 25, 1992

[51] Int. Cl.[5] ..... H01R 13/44

[52] U.S. Cl. ..... 439/138; 439/188

[58] Field of Search ..... 439/38-40; 439/692-696; 136-138, 200/51.09

[56] References Cited

U.S. PATENT DOCUMENTS

| | | | |
|---|---|---|---|
| 3,512,043 | 5/1970 | Jaaksoo et al. | 439/188 |
| 3,781,913 | 12/1973 | Wourdi | 439/692 |
| 3,982,084 | 9/1976 | Cooperstein | 439/188 |
| 4,230,386 | 10/1980 | Farnworth et al. | 439/188 |
| 4,758,696 | 7/1988 | Gracer | 439/188 |

*Primary Examiner*—Larry I. Schwartz
*Assistant Examiner*—Hien D. Vu
*Attorney, Agent, or Firm*—Alfred Lei

[57] ABSTRACT

This invention relates to an electrical plug and receptacle assembly and in particular to one including a housing divided into two separate chambers each having a slot, a pair of conducting clamps each fixedly mounted in one of the chambers of the housing and normally kept at a constant distance from the main conducting plates, a pair of main conducting plates each pivotally mounted in one of the chambers of the housing in such a way that each of the main conducting plates will contact a corresponding one of the conducting clamps when forced to turn outwardly, a pair of insulators each fixedly connected with an end of one of the conducting plates and just disposed against the slot of the housing, a pair of resilient members each urging one of the conducting plates inwardly against the central portion of the housing, a plug body having two blades, and a U-shaped sleeve with two prongs each having a longitudinal hole through which a corresponding one of the two blades of the plug body extends partially out of the sleeve when the plug body is inserted into the sleeve, and an inclined surface having a raised portion for engaging with a corresponding one of the insulators, whereby the electrical plug and receptacle assembly may provide greatest safety for the user.

2 Claims, 4 Drawing Sheets

ELECTRICAL PLUG AND RECEPTACLE ASSEMBLY

BACKGROUND OF THE INVENTION

It has been found that the prior art electrical plug and receptacle assembly has the following drawbacks:

1. The blades of the plug are often incompletely inserted into the receptacle thereby making it easier to be shocked by electricity.

2. Sparks will be produced by the breaking of an electric current when the plug is pulled out of the receptacle hence liably causing fire accident.

3. The plug cannot be firmly engaged with the receptacle and may be easier detached therefrom when subjected to an external force.

Therefore, it is an object of the present invention to provide an improved electrical plug and receptacle assembly which may obviate and mitigate the above-mentioned drawbacks.

SUMMARY OF THE INVENTION

This invention relates to an electrical plug and receptacle assembly.

It is the primary object of the present invention to provide an electrical plug and receptacle assembly which is secure in use.

It is another object of the present invention to provide an electrical plug and receptacle assembly which will prevent undesired objects from inserting therein.

It is still another object of the present invention to provide an electrical plug and receptacle assembly wherein the plug may be firmly engaged with the receptacle.

It is still another object of the present invention to provide an electrical plug and receptacle assembly which can be engaged with a particular plug.

It is a further object of the present invention to provide an electrical plug and receptacle assembly in which the blades of the plug are enclosed by an insulating sleeve hence providing further safety for the user.

Other objects and merits and a fuller understanding to the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 1:
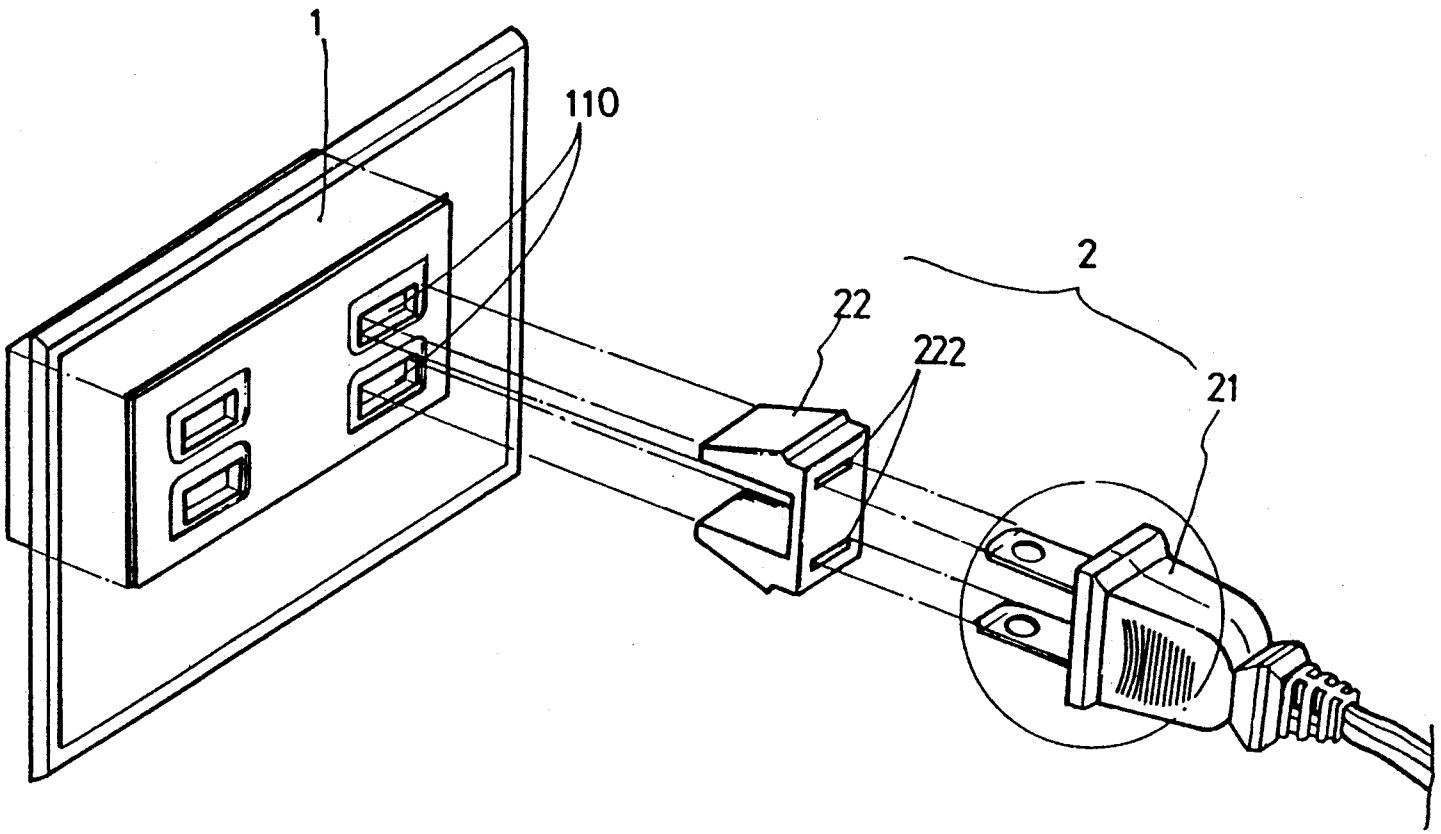
FIG. 1 is a perspective view of an electrical plug and receptacle assembly according to the present invention.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
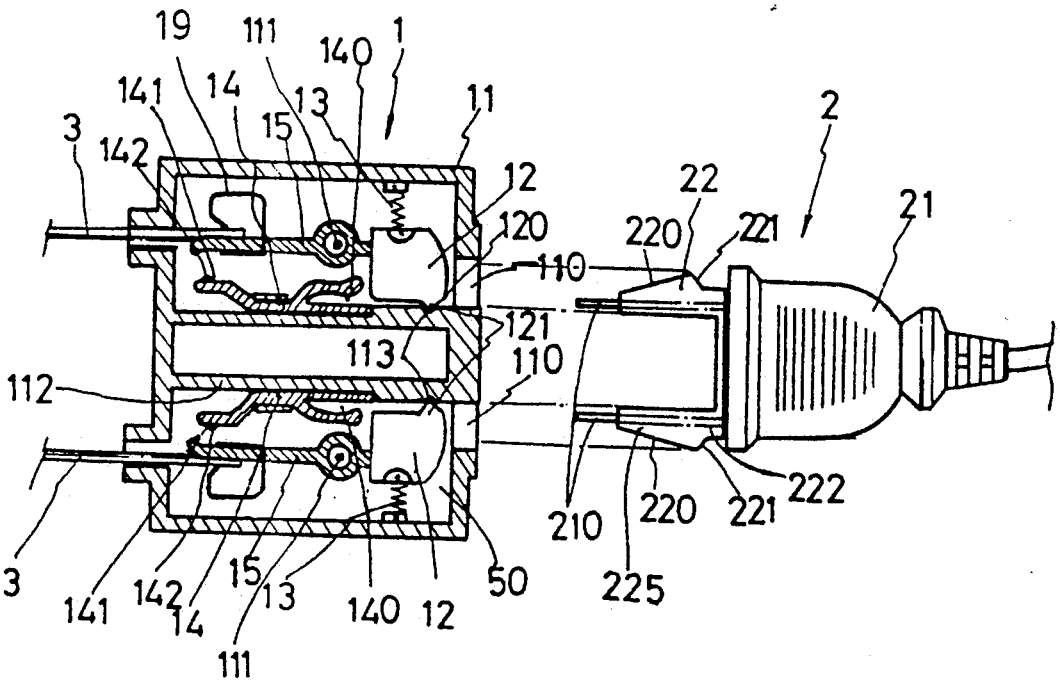
FIG. 2 is a sectional view of the present invention.

With reference to the drawings and in particular to FIG. 1 thereof, the present invention mainly comprises a receptacle 1 and a plug 2. As illustrated in FIG. 2, the receptacle 1 includes a housing 11, a pair of insulators 12, a pair of resilient members 13, a pair of conducting clamps 14, and a pair of main conducting plates 15. The interior of the housing 11 is divided into two separate chambers 50 each having a slot 110. In each of the chambers 50 there is a pin 111 on which the main conducting plate 15 is pivotally mounted so that the main conducting plate 15 may be turned about the pin 111 when subjected to external force. The upper end of the conducting plate 15 is fixedly connected with the insulator 12. The right end (with respect to FIG. 2) of the insulator 12 is just disposed against the slot 110, while the outer edge 121 of the insulator 12 is urged by the resilient member 13 against the groove 113 on the inner wall 112 of the housing 11. The tail end of the main conducting plate 15 is connected with a clamping member 19 which will fix an electrical wire 3 of a power cord in position when the electrical wire is inserted therein. Further, the conducting clamp 14 is fixedly mounted on the inner wall 112 of the housing 11. In addition, the conducting clamp 14 has a gripping portion 140 at the right end and a connecting portion 141 with a contact point 142 at the other (see FIG. 2). When not in use, the the main conducting plate 15 is kept at a constant distance from the conducting clamp 14 and in the meantime, no current will pass through the conducting clamp 14 and the insulator 12 will block the slot 110 of the housing 11.

As may be seen in FIGS. 1 and 2, the plug 2 is composed of a plug body 21 and a sleeve 22. The sleeve 22 is a U-shaped member with two tongs 225 each with an inclined surface 220 having a raised portion 221 and a longitudinal through hole 222. Hence, the plug body 21 may be inserted into the sleeve 22 with its blades 210 partially extending out of the sleeve 22.

Figure 4D:
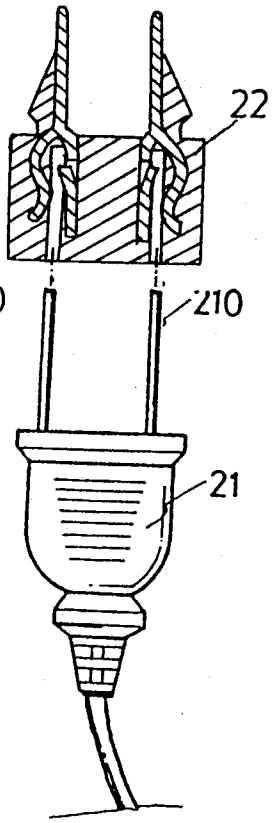
FIGS. 4A, 4B, 4C and 4D show various preferred embodiments of the plug.
Figure 4C:
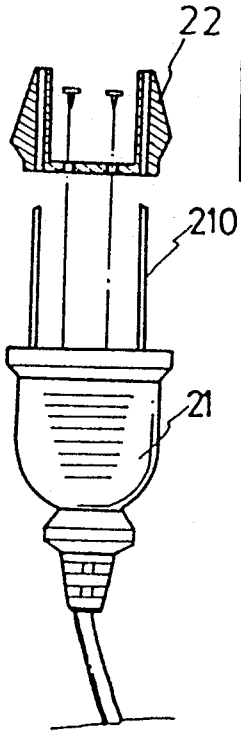
Figure 4B:
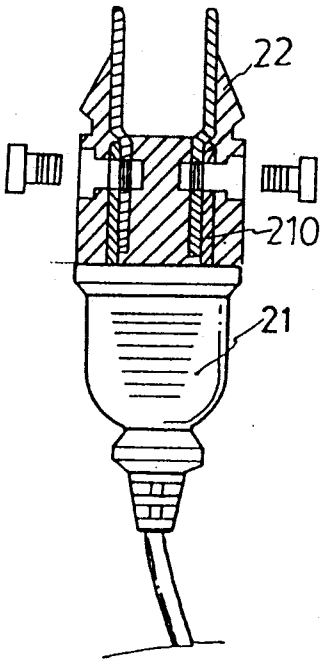
Figure 4A:
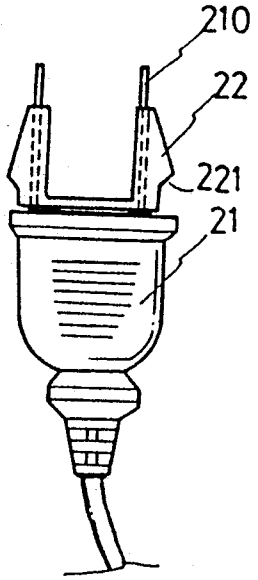

Looking now at FIGS. 4A, 4B, 4C and 4D, there are shown various embodiments of the plug 2. As shown in FIG. 4A, the sleeve 22 may be attached to the plug body 20 by an adhesive tape. FIG. 4B shows a plug 2 which is composed of a plug body 21 and a sleeve 22 which is engaged with the blades 210 of the plug body 21 by screws. As illustrated in FIG. 4C, the sleeve 22 directly engaged with the plug body 21 by screws extending through the sleeve 22 into the plug body 21. FIG. 4D shows another preferred embodiment of the plug wherein the sleeve 22 is snap-fitted with plug body 21.

Figure 3:
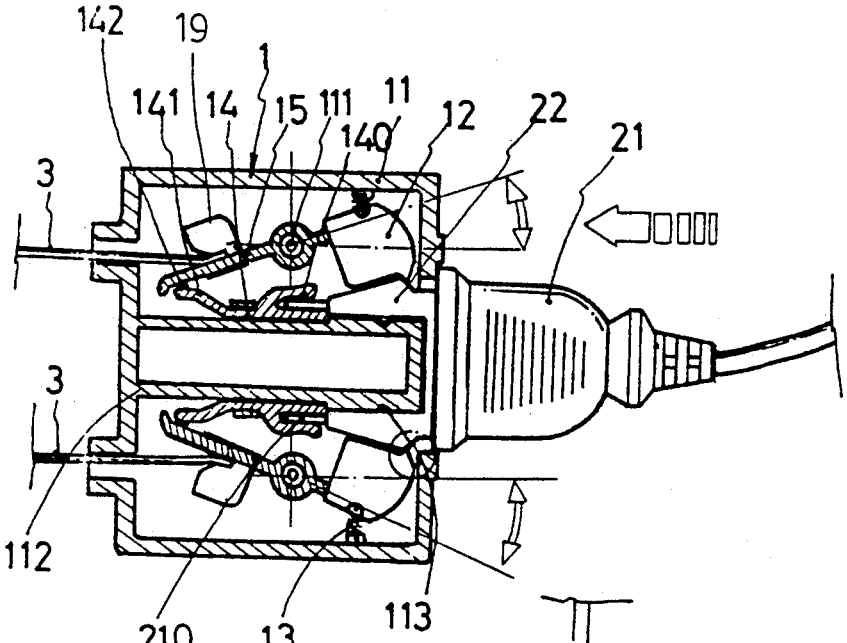
FIGS. 3 and 3A show the working principle of the present invention.
Figure 3A:
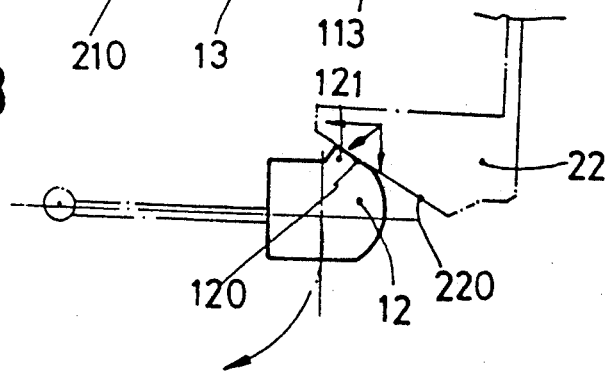

Referring to FIGS. 3 and 3A, when the plug 20 is inserted into the receptacle 1, the inclined surface 220 of the plug 20 will be in contact with the surface 120 of the insulator 12 and urge the insulator 12 to go sidewardly thereby engaging the insulator 12 with the raised portion 221 of the sleeve 22 and therefore keeping the plug 20 in position. Meanwhile, the insulator 12 will force the main conducting plate 15 to turn inwardly thus making it contact the conducting clamp 14 and the blade 210 will be inserted into the gripping portion 140 of the conducting clamp 14 thereby connecting the power cord 3 with the plug 2.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. An electrical plug and receptacle assembly comprising:

a housing divided into two separate chambers each having a slot;

a pair of conducting clamps each fixedly mounted in one of the chambers of said housing;

a pair of main conducting plates each pivotally mounted in one of the chambers of said housing in such a way that each of said main conducting plates will contact a corresponding one of said conducting clamps when forced to turn outwardly;

each of said conducting clamps being normally kept at a constant distance from a corresponding one of said conducting plates;

a pair of insulators each fixedly connected with an end of one of said conducting plates and disposed adjacent the slot of said housing;

a pair of resilient members each urging one of said conducting plates inwardly toward a central portion of said housing;

a plug body having two blades; and a U-shaped sleeve with two prongs each having a longitudinal hole through which a corresponding one of the two blades of said plug body extends partially out of said sleeve when said plug body is inserted into said sleeve, and an inclined surface having a raised portion for engaging with a corresponding one of said insulators.

2. The electrical plug and receptacle assembly as claimed in claim 1, wherein said plug body is fixedly connected with said sleeve.

* * * * *